US005484970A

United States Patent [19]

Suzuki et al.

[11] Patent Number: 5,484,970

[45] Date of Patent: Jan. 16, 1996

[54] ACOUSTIC INSULATOR

[75] Inventors: Masami Suzuki; Mitsuhiro Akano, both of Odawara; Katsumi Sugimoto; Hideyuki Kuroda, both of Tokyo, all of Japan

[73] Assignees: Zeon Kasel Co., Ltd., Tokyo; Fuji Photo Film Co., Ltd., Kanagawa, both of Japan

[21] Appl. No.: 253,558

[22] Filed: Jun. 3, 1994

[30] Foreign Application Priority Data

Jun. 7, 1993 [JP] Japan ..... 5-136013

[51] Int. Cl.[6] ..... E04B 1/84

[52] U.S. Cl. ..... 181/294; 181/286; 181/290; 181/292

[58] Field of Search ..... 181/210, 286, 181/290, 292, 294; 428/DIG. 920, DIG. 921, DIG. 903.3, 323, 900, 928, 457, 75, 76

[56] References Cited

U.S. PATENT DOCUMENTS 3,961,682 6/1976 Dausch et al. ..... 181/290

4,143,495 3/1979 Hintz ..... 181/290 X 4,709,781 12/1987 Scherzer ..... 181/290

5,272,284 12/1993 Schmanski ..... 181/210

FOREIGN PATENT DOCUMENTS 63-199739 8/1988 Japan .

63-199740 8/1988 Japan .

*Primary Examiner*—Khanh Dang

*Attorney, Agent, or Firm*—Nikaido, Marmelstein, Murray & Oram

[57] ABSTRACT

Disclosed is a novel acoustic insulator constituted by a shaped article obtained by adding a binder to shreds of a plastic coated with a magnetic material, such as a magnetic tape or magnetic sheet and shaping the same into a sheet or a block having a bulk specific gravity of 0.05 to 0.4 and a gas permeation resistance of 3 to 90 dyn.S/cm$^4$. Alternatively, shreds of a plastic coated with a magnetic material, such as a magnetic tape or magnetic sheet, are filled into casing members so that the bulk specific gravity of the composite product is 0.05 to 0.4 and its gas permeation resistance becomes 3 to 90 dyn.S/cm$^4$.

16 Claims, 2 Drawing Sheets

ACOUSTIC INSULATOR

BACKGROUND OF THE INVENTION

1. Field of the Invention

The present invention relates to a novel acoustic insulator used in locations where acoustic considerations are needed and locations where prevention of entry and leakage of sound is desirable, and in more detail relates to an acoustic insulator utilizing a plastic coated with a magnetic material such as a magnetic tape or magnetic sheet, particularly waste material of the same.

2. Description of the Related Art

Conventionally, as acoustic insulators, there are fibrous sound absorbing materials such as glass wool and rock wool and aluminum and other metal and ceramic porous sound absorbing materials. Also, concrete materials have an acoustic insulation performance. Further, also sheet materials such as plywood, gypsum plaster board, particle board, and metal sheets are used as acoustic insulators. Also, for the purpose of improving the sound absorption property of specific frequencies, perforated sheets etc. have been used.

However, the fibrous sound absorbing materials such as the aforesaid glass wool and rock wool have a moisture absorption property and water absorption property. As the amount of absorbed moisture and amount of absorbed water increase, the sound absorption performance is reduced. Also, sound absorbing materials of metals, ceramics, and concrete are heavy and expensive, and therefore are naturally restricted in their conditions of use. Also, sheet materials and perforated sheets generally have a low sound absorption performance. Further, perforated sheets have been used for special purposes and cannot be used as general purpose acoustic insulators in practice.

On the other hand, the amount of use of plastic coated with a magnetic material such as magnetic tape and magnetic sheet has been increasing year by year. The disposal of that type of refuse has in particular become a problem. Moreover, in the process of production of plastic coated with a magnetic material, the increase in the amount of production is accompanied with an increase in the amount of the substandard products which are disposed of as waste. The method of disposal of that waste is also becoming a problem.

As the method of utilizing the waste of plastic coated with a magnetic material, the methods of Japanese Unexamined Patent Publication No. 63-199739, Japanese Unexamined Patent Publication No. 63-199740, etc. are known. However, the techniques disclosed in these publications are techniques of producing recycled plastic products using the waste plastic coated with the magnetic materials, for example, sheets for pavement of roads and vibration dampening sheets. The objects thereof are to obtain recycled plastic products. The obtained products could not be used as acoustic insulators having satisfactory sound absorption performance.

SUMMARY OF THE INVENTION

The present inventors have been engaged in repeated studies in various areas regarding an acoustic insulator which is excellent in the sound absorption performance, excellent also in the moisture resistance and waterproofness, and cheap, consequently they have determined that an acoustic insulator obtained by shredding or pulverizing (collectively referred to in this specification as "shredding") waste plastic coated with a magnetic material such as magnetic tape or magnetic sheet coated with, for example, a magnetic powder shaping the shreds into a sheet or a block or appropriately filling then into a casing member, such as a bag-shaped member or case-shaped member, exhibits a good sound absorption performance. The excellent sound adsorptions is due to the appropriate void proportion and the elasticity of the magnetic tape film, and to its large local surface density. This product has excellent characteristics also in its moisture resistance and waterproofness due to a fact that it is a plastic. Thus the present invention has been perfected.

The present invention has been made in consideration of the real world and has as an object thereof to obtain an acoustic insulator, which has a good sound absorption characteristic and in addition is excellent in moisture resistance and waterproofness, by utilizing a plastic coated with a magnetic material, such as magnetic tape or magnetic sheet, particularly utilizing the waste thereof.

To achieve the above-described object, the first embodiment of the acoustic insulator of this invention utilizing a plastic coated with a magnetic material is a shaped article shaped into a sheet or a block having a bulk specific gravity of 0.05 to 0.4 and a gas permeation resistance of 3 to 90 dyn.S/cm$^4$. This shaped article is made binder to shreds of a plastic coated with a magnetic material, such as a magnetic tape or magnetic sheet.

Also, the second embodiment of an acoustic insulator according to this invention utilizing a plastic coated with a magnetic material is one obtained by filling shreds of a plastic coated with a magnetic material, such as a magnetic tape or magnetic sheet into a casing member so that the bulk specific gravity of the filled casing is 0.05 to 0.6 and its gas permeation resistance is 3 to 90 dyn.S/cm$^4$.

As a magnetic tape of the plastic coated with a magnetic material, an audio tape, video tape, computer tape, and so on can be exemplified. Also, as a magnetic sheet, a floppy disk etc. can be exemplified. A magnetic tape is constituted by a magnetic layer, base film, and a slippery back layer, but there also exist tapes having no back layer. The magnetic layer is constituted by a magnetic powder using iron oxide, metal, barium ferrite, or the like; a binder using a vinyl chloride resin, nitrocellulose, polyurethane resin, polyester resin, or the like; and in addition a cross-linking agent, lubricant, polishing agent, antistatic agent, etc. As the magnetic layer, there also exists one having a multi-layer structure. Moreover, a third embodiment of this invention envisions part of the multi-layer being constituted by a non-magnetic filler in addition to the above described magnetic tape filler.

As the base film, a polyester film has been frequently used. Moreover, also a polyethylenenaphthalate, polyaramide, etc. have been used. The back layer is constituted by a carbon black powder etc.; a binder such as that used for the magnetic layer; and an additive.

It is sufficient if the magnetic tape used in the present invention has a structure of a magnetic layer superposed on a base film. The back layer may further be provided or not provided. Also, the materials used for each of these are not critical.

The shreds of the plastic coated with a magnetic material are obtained by processing waste, such as for example magnetic tape or magnetic sheet, by a shredder such as a rotary cutter. The size of the shreds is determined by the size of the mesh of the screen provided in the rotary cutter and is not particularly restricted, but preferably the size is about 2 to 20 mm in length (or diameter).

Also, as the shreds, pieces obtained by shaping the magnetic tape or the magnetic sheet in advance into a concave-convex shape and then shredding it can be used, and also mixtures of pieces obtained by shaping it into a concave-convex shape and then shredding and pieces obtained by merely shredding it may be used. So as to obtain the concave-convex shape, a tape or a sheet is inserted between a convex mold and a concave mold and pressed. It is also possible to perform the pressing by a flat mold or using a roll-shaped mold so as to continuously perform the molding.

Moreover, it is also possible to use at least a part of said shreds which consist of curled shreds which have been curled by heat-treatment. A "curl" in this context means a shape which is approximately circular in which the two ends lift up in the case of for example short shreds or means wrinkled wavy shreds in the case of long shreds. So as to curl the shreds, generally in the case of a magnetic tape using a polyester resin as the base film, it is sufficient if the shreds are exposed to an ambient temperature of 100° to 150° C. The heating conditions can be appropriately set according to the shape of the shreds, amount treated, etc. By curling the shreds, a complex fine pore shape is obtained in comparison with simple shreds. Further, an acoustic insulator having a small bulk specific gravity can be easily obtained and, at the same time, also the acoustic insulation performance is improved.

The first acoustic insulator of a plastic coated with a magnetic material of the present invention is a shaped article obtained by mixing a filler with shreds prepared by cutting or shredding and shaping the same into a sheet or a block using a binder such as a latex or the like mentioned later. The filler for obtaining the shaped article is not particularly limited, but a filler such as pulp, saw dust, or inorganic filler material can be used.

It is possible to make the first acoustic insulator of a plastic film coated with a magnetic material of the present invention by shaping this article into a sheet or a block alone, but it is also possible to make it by filling this shaped article into a casing member such as a bag-shaped member or case-shaped member.

Also, the second acoustic insulator of a plastic coated with a magnetic material of the present invention is obtained by simply filling the shreds of a plastic coated with a magnetic material, such as a magnetic tape or magnetic sheet described above, into a casing member, such as a bag-shaped member, or case-shaped member without shaping the pieces into a sheet or a block. Note that, it is also possible to mix simple shreds and a shaped article obtained by molding the shreds and use both together to fill a casing member.

Preferably said casing member is constituted by a bag-shaped member having gas permeability or a case-shaped member having gas permeability.

It is also possible to fill the shreds in the casing member in layers or fill the same at random. Moreover, so as to uniformly fill the same, it is also possible to arrange honeycomb-shaped partition plates in the interior of the casing member and to fill the shreds between these partition plates. As the bag-shaped member used as the casing member, paper, a plastic film, woven fabric, nonwoven fabric, etc. or a composite of the can be used, while not particularly limited preferably the casing is a thin bag-shaped member or a bag-shaped member having gas permeability from the viewpoint of the improvement of the sound absorption performance. As the case-shaped member used as the casing member, a member made of wood, metal, plastic, or the like is used, but it is not particularly preferred. The material and shape are designed in accordance with the purpose and object of use.

So as to obtain a preferred sound absorption performance, it is necessary to set the bulk specific gravity of the article shaped from the shreds or the filled shreds within a range of 0.05 to 0.4 and set the gas permeation resistance of the article shaped from the shreds or the filled shreds within a range of from 3 to 90 dyn.S/cm$^4$. In general, the mechanism of the sound absorption can be explained as follows: when a sound wave enters into the sound absorption body, the air in the fine pores vibrates. At this time, friction occurs between the air and inner wall surfaces of the fine pores, so the acoustic energy is converted to heat energy and absorbed.

If the bulk specific gravity is 0.05 or less or the gas permeation resistance is 3 dyn.S/cm$^4$ or less, the resistance is too small, and therefore even if friction is caused with respect to entry of a sound wave, it is very small. Also, when the bulk specific gravity is 0.4 or more or the gas permeation resistance is 90 dyn.S/cm$^4$ or more, a state where fine pores are closed is exhibited and, therefore, similarly, even if friction is caused, it is very small. Accordingly, a preferable sound absorption performance cannot be obtained in a range other than the above-described range.

So as to obtain a sheet-shaped or block-shaped article having a bulk specific gravity of within 0.05 to 0.4 and a gas permeation resistance within 3 to 90 dyn.S/cm$^4$ as a strong aggregate, preferably the shreds are bridged together by a binder. The binder is not particularly limited, but use is made of, for example, latexes such as acrylonitrile-butadiene copolymer (NBR), vinyl acetate, or vinyl acetate-ethylene copolymer (EVA), styrene-butadiene copolymer (SBR), polyacrylic acid ester, polyurethane, etc.

So as to obtain a shaped article having a constant shape such as a sheet, block, or the like from the shreds, it is sufficient to add the aforementioned filler, a binder such as a latex, and, if necessary, a flame retardant material mentioned later to the shreds, blend them using a liquid such as water, pour the result into a mold, and press to remove the water. The heating temperature at the time of the press drying is not particularly limited, but is for example 100° C. or more, and the pressing time is about several minutes to several hours.

However, where the shreds used in the present invention are filled into a preliminarily shaped casing member such as a bag-shaped member or case-shaped member, the amount of the above-described binder can be reduced to a minimum. In certain cases, it is possible to obtain an acoustic insulator able to withstand usage even using no binder at all.

Note that, in the aspect of the present invention which is a shaped article obtained by shaping shreds into a sheet or a block, where for example the base film of the shreds is a polyester or the like, the amount of generation of smoke at the time of burning is small and, in addition, the article contains an inorganic substance, and therefore generally a flame retardant property is imparted. However, so as to further improve the flame retardant property, when the shaped article made of the shreds is to be obtained, it is effective if a flame retardation-imparting material, such as hydrated lime, aluminum hydroxide, calcium hydroxide, magnesium hydroxide, antimony trioxide, etc. is added together with the above-described latex.

In the aspect of the present invention which is an article obtained by shaping the shreds into a sheet or a block, the proportion of incorporation of the shreds, filler, binder and the flame retardant material is not particularly limited, but preferably the amount of the filler is 0.01 to 10 percent by weight, the amount of the binder such as the latex is 10 to 90 percent by weight, and the amount of the flame retardant material is 0.01 to 50 percent by weight all based on 100 parts by weight of the shreds. It is not always necessary to incorporate a filler or a flame retardant material in the acoustic insulator of the present invention. Also, in the acoustic insulator of the present invention with the shreds filled in a casing member, it is not necessary either to use a binder such as a latex.

BRIEF DESCRIPTION OF THE DRAWINGS

Other objects and features of the present invention will be described in detail with reference to accompanying drawings, in which.

DESCRIPTION OF THE PREFERRED EMBODIMENTS

An explanation will be made below of acoustic insulators made from a plastic coated with a magnetic material according to examples of the present invention, but the present invention is not restricted to these examples.

Example 1

Figure 1:
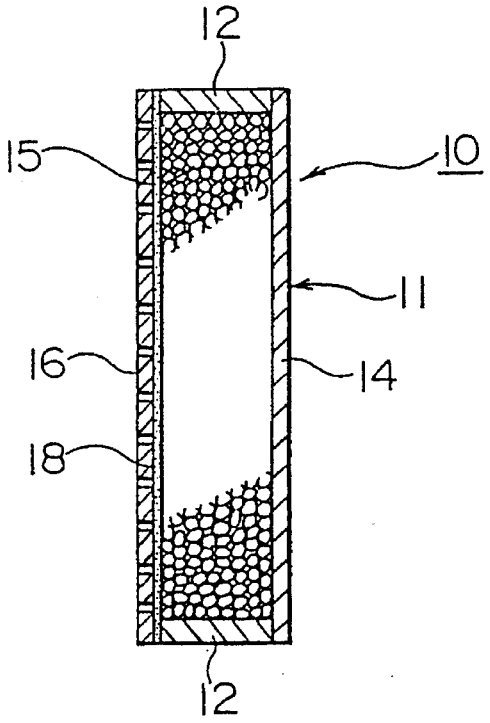
FIG. 1 is a cross-sectional view of a principal part of an acoustic insulator according to one example of the present invention.
Figure 3:
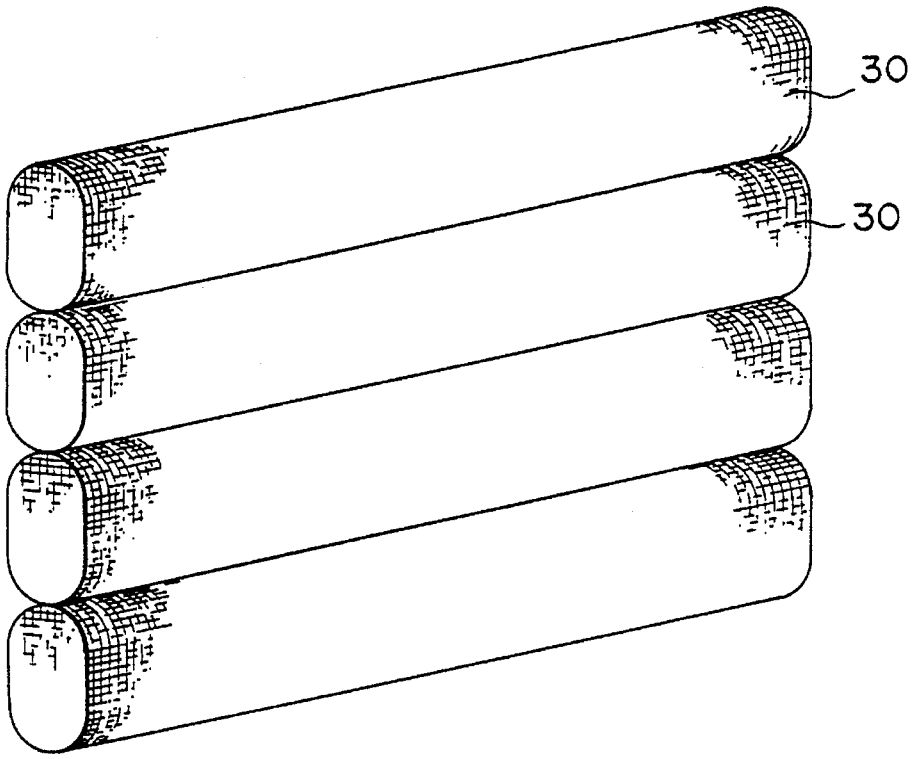
FIG. 3 is a perspective view of several bag members attached together to form a wall.

One example of the acoustic insulator comprised of shreds of waste of a plastic coated with a magnetic material filled in a casing member is shown in FIG. 1. In an acoustic insulator 10 shown in FIG. 1, shreds 15 of waste of a plastic coated with a magnetic material, or an article comprising the shreds shaped into a block (see 30 in FIG. 3), or a mixture of the shreds and shaped article is filled in a casing member 11 constituted by a frame member 12, non-porous plywood 14, and porous plywood 16. It is also possible to attach a nonwoven fabric etc. having an excellent gas permeability to the back surface of the porous plywood 16. Moreover, it is also possible to arrange sheets of porous plywood 16 on both surfaces in place of the non-porous plywood 14 to constitute the casing member 11.

Example 2

As the plastic coated with a magnetic material, use was made of a magnetic tape using a polyester film as the base tape but without a back layer. This was shredded by a rotary cutter, so that shreds having a flake surface area of about 0.3 $cm^2$ were obtained. The shreds were placed in the casing member 21 shown in FIG. 2, and thereby an acoustic insulator 20 according to the present example was obtained. The casing member 21 shown in FIG. 2 comprises a brass tube 22 and a perforated aluminum sheet 24 attached to the two sides of the inside thereof via a spacer 23. The shreds 15 are filled inside the perforated aluminum sheet 24 via a polyester-based nonwoven fabric 26. Note that, the perforations were made with a diameter of 5 mmϕ and a pitch of 8 mm.

In the present example, the above-described shreds were filled inside this casing member 21 so that the bulk specific gravity is 0.17 and the gas permeation resistance is 8.0 dyn.S/$cm^4$. The thickness of the mass of filled shreds was 25 mm. Also, the thickness of the air layer 28 on the back side was 25 mm. Note that, the measurement of the gas permeation resistance was carried out according to JIS-A6306.

Figure 4:
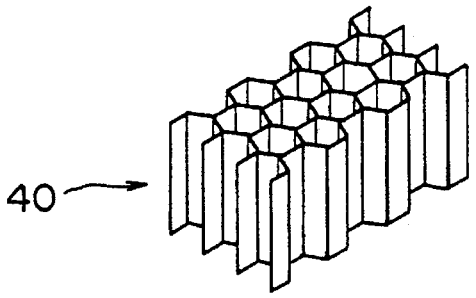
FIG. 4 is a perspective view of a honeycomb insert.

FIG. 4, a honeycomb (hexagonal) shaped partition 40 is shown for insertion into a bag member 21.

The results of measurement of the sound absorption rate, indicating the sound absorption performance, using the acoustic insulator 21 of the present example are shown in Table 1. Note that, for the sound absorption performance, a comparison was made of the sound absorption rates at 250 Hz, 500 Hz, and 1000 Hz. The sound absorption rate was measured according to a vertical incident measurement method of JIS-A1405.

TABLE 1

Measurement specimens of vertical incident sound absorption rate and results of measurement

| | Examples | | | | |
|---|---|---|---|---|---|
| | 2 | 3 | 4 | 5 | 6 |
| Specimens | | | | | |
| Material | Magnetic tape | Magnetic tape | Magnetic tape | Magnetic tape | Magnetic tape |
| Flake surface area ($cm^2$) | Approx. 0.3 | Approx. 0.3 | Approx. 3 | Approx. 0.3 | Approx. 0.3 |
| Flake shape | Flat | Flat | Flat | Convex-concave | Flat |
| Apparent specific gravity | 0.17 | 0.08 | 0.17 | 0.17 | 0.35 |
| Gas permeation resistance (dyn · s/$cm^4$) | 8.0 | 4.0 | 15.0 | 11.0 | 80.0 |
| Thickness (mm) | 25 | 25 | 25 | 25 | 25 |
| Back air layer (mm) | 25 | 25 | 25 | 25 | 25 |
| Performance | | | | | |
| 250 Hz | 0.35 | 0.25 | 0.35 | 0.32 | 0.35 |
| 500 Hz | 0.65 | 0.45 | 0.80 | 0.80 | 0.65 |

TABLE 1-continued

| Measurement specimens of vertical incident sound absorption rate and results of measurement | | | | | |
|---|---|---|---|---|---|
| | Examples | | | | |
| | 2 | 3 | 4 | 5 | 6 |
| 1000 Hz | 0.95 | 0.90 | 0.70 | 0.80 | 0.85 |

Example 3

Figure 2:
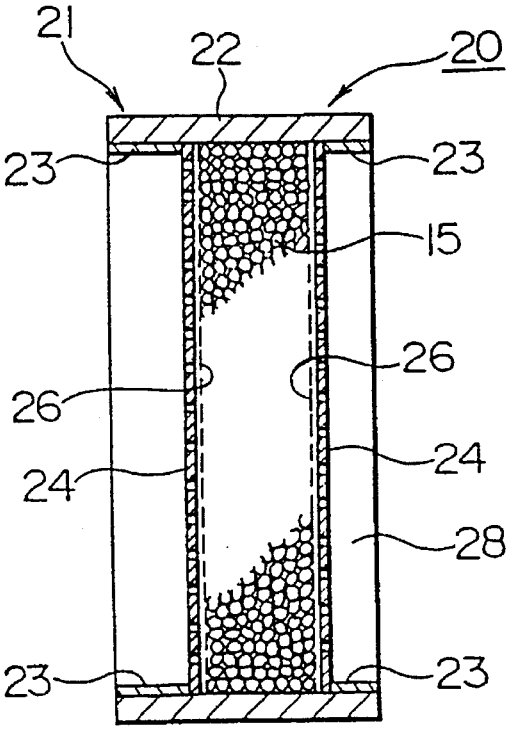
FIG. 2 is a schematic cross-sectional view of a casing member for testing a sound absorption characteristic of acoustic insulators according to examples of the present invention.

The same procedures as those described in Example 2 were carried out except the shreds used in Example 2 were filled in the casing member 21 shown in FIG. 2 so that the bulk specific gravity was 0.08 and the gas permeation resistance was 4.0 dyn.S/cm$^4$. The sound absorption rate was measured. The results are shown in Table 1.

Example 4

The same procedures as those described in Example 2 were carried out except the flake surface area of the shreds was set to about 3 cm$^2$, and these shreds were filled in the casing member 21 shown in FIG. 2 so that the bulk specific gravity was 0.17 and the gas permeation resistance was 15.0 dyn.S/cm$^4$. The sound absorption rate was measured. The results are shown in Table 1.

Example 5

The same procedure as that described in Example 2 were carried out except the magnetic tape used in Example 2 was passed through a roll-shaped press, a large number of fine concavities-convexities having a size of 3 mm were formed in the surface of the magnetic tape, this was shredded by a rotary cutter, shreds having a flake surface area of about 0.3 cm$^2$ were obtained, and these shreds were filled in the casing member 21 shown in FIG. 2 so that the bulk specific gravity was 0.17 and the gas permeation resistance was 11.0 dyn.S/cm$^4$. The sound absorption rate was measured. The results are shown in Table 1.

Example 6

Three parts by weight of pulp fiber, 45 parts by weight of NBR latex, and 5 parts by weight of flame retardant material constituted by hydrated lime based on 100 parts by weight of the shreds used in Example 2 were mixed using 700 parts by weight of water, the liquid mixture was poured into a mold, and a pressurizing force of 30 kg/cm$^2$ was applied to perform the shaping, whereby a shaped article of an acoustic insulator having a thickness of 25 mm was obtained. This shaped article of an acoustic insulator was placed in the brass tube 22 shown in FIG. 2, and the sound absorption rate was measured in the same way as in Example 2. The results thereof are shown in Table 1.

Referential Example 1

Glass wool was used as the acoustic insulator. This glass wool was placed in the casing member 21 shown in FIG. 2 so that its bulk specific gravity was 0.032 and the gas permeation resistance was 5.0 dyn.S/cm$^4$. The measurement of the sound absorption rate was carried out in the same way as in Example 2. The results are shown in Table 2.

TABLE 2

| Measurement specimens of vertical incident sound absorption rate and results of measurement | | | | | |
|---|---|---|---|---|---|
| | Reference | Comparative example | | | |
| | example | 1 | 2 | 3 | 4 |
| Specimens | | | | | |
| Material | Glass wool | Magnetic tape | Magnetic tape | Magnetic tape | Magnetic tape |
| Flake surface area (cm$^2$) | — | Approx. 0.3 | Approx. 0.3 | Approx. 0.3 | Approx. 0.3 |
| Flake shape | | Flat | Flat | Flat | Flat |
| Apparent specific gravity | 0.032 | 0.02 | 0.70 | 0.08 | 0.50 |
| Gas permeation resistance (dyn · s/cm$^4$) | 5.0 | 0.01 | 100 | 0.01 | 100 |
| Thickness (mm) | 25 | 25 | 25 | 25 | 25 |
| Back air layer (mm) | 25 | 25 | 25 | 25 | 25 |
| Performance | | | | | |
| 250 Hz | 0.20 | 0.10 | 0.20 | 0.10 | 0.25 |
| 500 Hz | 0.50 | 0.20 | 0.30 | 0.30 | 0.40 |
| 1000 Hz | 0.90 | 0.45 | 0.40 | 0.40 | 0.30 |

Comparative Example 1

The same procedures as those described in Example 2 were carried out except that the shreds used in Example 2 were filled in the casing member 21 shown in FIG. 2 so that its bulk specific gravity was 0.02 and the gas permeation resistance was 0.01 dyn.S/cm$^4$. The sound absorption rate was measured. The results are shown in Table 2.

Comparative Example 2

The same procedures as those described in Example 2 were carried out except the shreds used in Example 2 were filled in the casing member 21 shown in FIG. 2 so that its bulk specific gravity was 0.5 and its gas permeation resistance was 100 dyn.S/cm$^4$. The sound absorption rate was measured. The results are shown in Table 2.

Comparative Example 3

The same procedures as those described in Example 2 were carried out except the shreds used in Example 2 were filled in the casing member 21 shown in FIG. 2 so that its bulk specific gravity became 0.08 and its gas permeation resistance was 0.01 dyn.S/cm$^4$. The sound absorption rate was measured. The results are shown in Table 2.

Comparative Example 4

The same procedures as those described in Example 2 were carried out except the shreds used in Example 2 were filled in the casing member 21 shown in FIG. 2 so that its bulk specific gravity became 0.3 and its gas permeation resistance was 100 dyn.S/cm$^4$. The sound absorption rate was measured. The results are shown in Table 2.

Example 7

The same procedures as those described in Example 2 were carried out except the shreds used in Example 2 and having a flake surface area of about 0.3 cm$^2$ were heat-treated in an atmosphere of 130° C. to obtain curled shreds, and these curled shreds were filled in the casing member 21 shown in FIG. 2 so its bulk apparent specific gravity was 0.17 and its gas permeation resistance was 26.0 dyn.S/cm$^4$. The sound absorption rate was measured. The results are shown in Table 3.

TABLE 3

Measurement specimens of vertical incident sound absorption rate and results of measurement

| | Examples | | |
|---|---|---|---|
| | 7 | 8 | 9 |
| Specimens | | | |
| Material | Magnetic tape | Magnetic tape | Magnetic tape |
| Flake surface area (cm$^2$) | Approx. 0.3 | Approx. 0.3 | Approx. 0.3 |
| Flake shape | Curled | Flat/Curled | Curled |
| Apparent specific gravity | 0.17 | 0.17 | 0.32 |
| Gas permeation resistance (dyn · s/cm$^4$) | 26.0 | 20.0 | 30.0 |
| Thickness (mm) | 25 | 25 | 25 |
| Back air layer (mm) | 25 | 25 | 25 |
| Performance | | | |
| 250 Hz | 0.35 | 0.35 | 0.40 |
| 500 Hz | 0.80 | 0.70 | 0.75 |
| 1000 Hz | 0.95 | 0.90 | 0.95 |

Example 8

The same procedures as those described in Example 2 were carried out except the shreds used in Example 2 and having a flake surface area of about 0.3 cm$^2$ were heat-treated in an atmosphere of 130° C. to obtain curled shreds, these curled shreds and flat shreds before the heat treatment were blended with a weight ratio of 1 versus 1, and they were filled in the casing member 21 shown in FIG. 2 so that its bulk specific gravity was 0.17 and its gas permeation resistance was 20.0 dyn.S/cm$^4$. The sound absorption rate was measured. The results are shown in Table 3.

Example 9

The same procedures as those described in Example 2 were carried out except the shreds used in Example 2 and having a flake surface area of about 0.3 cm$^2$ were heat-treated in an atmosphere of 130° C. to obtain curled shreds, and these curled shreds were filled in the casing member 21 shown in FIG. 2 so that its bulk specific gravity was 0.32 and its gas permeation resistance was 30.0 dyn.S/cm$^4$. The sound absorption rate was measured. The results are shown in Table 3.

Evaluation

When comparing Examples 2 to 9 and Comparative Examples 1 to 4, it was confirmed that the sound absorption characteristics of the acoustic insulators of the present examples were better than those of the comparative examples. Also, the sound absorption characteristic of the acoustic insulator of the present example is the same or higher than the sound absorption characteristic of the glass wool of the comparative example, but is better in moisture resistance and waterproofness in comparison with the material in the comparative example, and therefore the effectiveness of the present invention as the acoustic insulator was confirmed.

As explained above, the acoustic insulator of the present invention features a sound absorption performance of at least an equivalent level in comparison with a fibrous acoustic insulator, such as glass wool, and is cheap and excellent in the moisture resistance and waterproofness. Further, it must be noted that an epoch-making solution to the disposal of magnetic tape etc. is found by the present invention.

We claim:

1. An acoustic insulator shaped into a sheet or a block comprising shreds of plastic coated with a magnetic material, said insulator having a bulk specific gravity of 0.05 to 0.4 and a gas permeation resistance of 3 to 90 dyn.S/cm$^4$.

2. The acoustic insulator as set forth in claim 1, further comprising a binder of 10 to 90 percent by weight to said shreds of 100 percent by weight.

3. The acoustic insulator as set forth in claim 1, further comprising a binder, a filler, and a flame retardant material admixed with said shreds.

4. The acoustic insulator as set forth in claim 3, wherein the amount of the binder is 10 to 90 percent by weight, the amount of the filler is 0.01 to 10 percent by weight, and the amount of the flame retardant material is 0.01 to 50 percent by weight based on 100 percent by weight of said shreds.

5. The acoustic insulator as set forth in claim 1, wherein each of said shreds is 2 to 20 mm in length or diameter.

6. The acoustic insulator as set forth in claim 1, wherein at least a part of said shreds consists of curled shreds.

7. The acoustic insulator as set forth in claim 1, wherein at least a part of said shreds have a concave-convex shape.

8. An acoustic insulator comprising a casing member and shreds of plastic coated with a magnetic material filled in said casing member thus forming a composite structure having a bulk specific gravity of 0.05 to 0.4 and a gas permeation resistance of 3 to 90 dyn.S/cm$^4$.

9. The acoustic insulator as set forth in claim 8, wherein said casing member is selected from a bag-shaped member having gas permeability and a case-shaped member having gas permeability.

10. The acoustic insulator as set forth in claim 8, wherein said shreds are 2 to 20 mm in square or diameter cross section.

11. The acoustic insulator as set forth in claim 8, wherein at least a part of said shreds consists of curled shreds.

12. The acoustic insulator as set forth in claim 8, wherein at least a part of said shreds have a concave-convex shape.

13. The acoustic insulator as set forth in claim 8, wherein at least a part of said shreds are admixed with a binder of 10 to 90 percent by weight to said shreds of 100 percent by weight.

14. The acoustic insulator as set forth in claim 8, wherein said casing member comprises honeycomb-shaped partition plates in the interior thereof so that said shreds are filled between said partition plates.

15. The acoustic insulator as claimed in claim 1, wherein said shreds comprise magnetic tape.

16. The acoustic insulator as claimed in claim 11, wherein said shreds are heat curled.

* * * * *

UNITED STATES PATENT AND TRADEMARK OFFICE

CERTIFICATE OF CORRECTION

PATENT NO. : 5,484,970

DATED : Jan. 16, 1996

INVENTOR(S) : Suzuki et al.

It is certified that error appears in the above-indentified patent and that said Letters Patent is hereby corrected as shown below:

Title Page:

[73] delete "Zeon Kasel Co., Ltd." and insert therefor --Zeon Kasei Co., Ltd.--

Signed and Sealed this

Eighteenth Day of June, 1996

*Attest:*

*Attesting Officer*

BRUCE LEHMAN

*Commissioner of Patents and Trademarks*